US012416119B2

(12) United States Patent
Wei et al.

(10) Patent No.: US 12,416,119 B2
(45) Date of Patent: Sep. 16, 2025

(54) RUBBER PARTICLE-DOPED COMPOSITE CHIP SEAL AND CONSTRUCTION METHOD THEREOF

(71) Applicant: Changsha University of Science & Technology, Changsha (CN)

(72) Inventors: Jianguo Wei, Changsha (CN); Yuming Zhou, Changsha (CN); Hao Yue, Changsha (CN); Anmin Zou, Changsha (CN); Ping Li, Changsha (CN); Haolong Ju, Changsha (CN); Qiucai Nan, Changsha (CN); Min Fu, Changsha (CN)

(73) Assignee: CHANGSHA UNIVERSITY OF SCIENCE & TECHNOLOGY, Changsha (CN)

( * ) Notice: Subject to any disclaimer, the term of this patent is extended or adjusted under 35 U.S.C. 154(b) by 0 days.

(21) Appl. No.: 18/600,547

(22) Filed: Mar. 8, 2024

(65) Prior Publication Data

US 2025/0145829 A1 May 8, 2025

(30) Foreign Application Priority Data

Nov. 3, 2023 (CN) ..... 202311456926.7

(51) Int. Cl.
*E01C 7/18* (2006.01)

(52) U.S. Cl.
CPC ..... *E01C 7/18* (2013.01)

(58) Field of Classification Search
CPC ... E01C 7/08; E01C 7/18; E01C 7/182; E01C 7/26; E01C 7/265
(Continued)

(56) References Cited

U.S. PATENT DOCUMENTS 5,788,407 A * 8/1998 Hwang ..... E01C 7/14 404/81
5,957,619 A * 9/1999 Kinoshita ..... E01C 5/003 404/31
2010/0047015 A1* 2/2010 Takamura ..... E01C 7/353 404/31

FOREIGN PATENT DOCUMENTS

CN 203514194 U * 4/2014
JP 2001329503 A * 11/2001
(Continued)

OTHER PUBLICATIONS

Liang, He et al., "Rubber Modification and Its Influence on the Properties of Rubbert Cement Matrix", Bulletin of the Chinese Ceramic Society, vol. 36 No. 2, Mar. 2017, in 6 pages (with translation).

(Continued)

*Primary Examiner* — Gary S Hartmann
(74) *Attorney, Agent, or Firm* — Procopio, Cory, Hargreaves & Savitch LLP

(57) ABSTRACT

A rubber particle-doped composite chip seal and a construction method thereof. The rubber particle-doped composite chip seal includes a coarse aggregate in a lower layer, a fine aggregate in an upper layer, and an SBS-modified emulsified asphalt binding and encapsulating the coarse aggregate and the fine aggregate into a whole, wherein the coarse aggregate is a gravel having a particle size of 4.75 mm to 7.1 mm, the fine aggregate is rubber particles having a particle size of 1.18 mm to 4.75 mm after pre-treatment, and the fine aggregate has a doping amount of 30% to 45% of a volume of all aggregates.

5 Claims, 1 Drawing Sheet

(58) Field of Classification Search
USPC ..... 404/31, 32
See application file for complete search history.

(56) References Cited

FOREIGN PATENT DOCUMENTS

| | | | | |
|---|---|---|---|---|
| KR | 100690393 B1 * | 3/2007 | ..... | E01C 11/24 |
| KR | 102625465 B1 * | 1/2024 | ..... | E01C 7/26 |

OTHER PUBLICATIONS

First Office Action received in CN202311456926.7, dated Apr. 14, 2024, in 8 pages (with translation).
Notification to Grant Patent Right for Invention received in CN202311456926.7, dated May 17, 2024, in 3 pages (with translation).

* cited by examiner

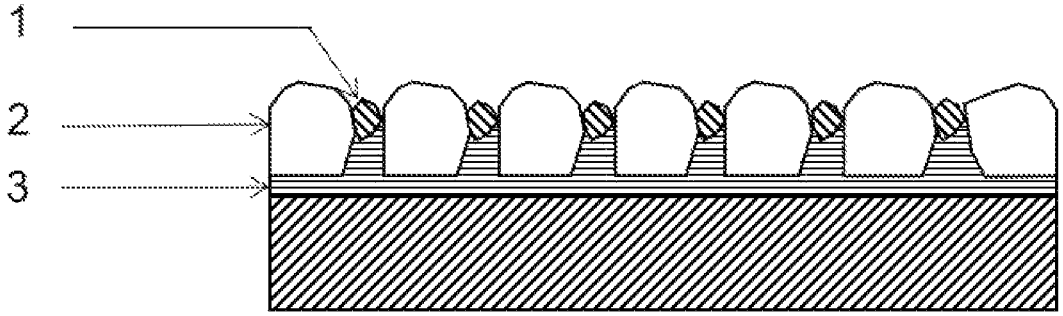
1
2
3

RUBBER PARTICLE-DOPED COMPOSITE CHIP SEAL AND CONSTRUCTION METHOD THEREOF

CROSS REFERENCE TO RELATED APPLICATION

This patent application claims the benefit and priority of Chinese Patent Application No. 2023114569267 filed with the China National Intellectual Property Administration on Nov. 3, 2023, and entitled with "RUBBER PARTICLE-DOPED COMPOSITE CHIP SEAL AND CONSTRUCTION METHOD THEREOF", the disclosure of which is incorporated by reference herein in its entirety as part of the present application.

TECHNICAL FIELD

The present disclosure belongs to the technical field of road engineering, and specifically relates to a rubber particle-doped composite chip seal and a construction method thereof.

BACKGROUND

Chip seal can be directly spread on low-grade pavements as a surface layer to extend the service life of highways, can also be used as a transitional pavement to alleviate the shortage of highway construction funds, and can further be used as a means of pre-maintenance for ordinary asphalt pavements. When the chip seal is used in pavement maintenance, problems such as rutting and subsidence can be solved by using a construction method of local spreading gravels of different particle sizes. The chip seal has simple processes, fast construction, and reduced project costs.

Currently, the gradation of the chip seal generally adopts single gradation and composite gradation. However, these two gradations still have the following shortcomings in actual engineering application: (1) The single gradation cannot ensure that each aggregate has a similar size, and there are individual aggregates with protruding edges and corners that are prone to falling off due to external effects. When the vehicle speed is too high and the traffic volume is large, the gravel on the pavement may easily fall off, causing the chip seal pavement to fail. (2) More aggregates in the composite gradation occupy the binder filling space, and generally lead to problems such as insufficient embedment depth of some aggregates and segregation of coarse and fine aggregates during spreading, which may affect the structural strength and bearing capacity, The decrease in the structural bearing capacity can destroy a safety performance of the pavement structure. In the existing construction technology of composite chip seal, heating asphalt and gravel to between 140° C. and 160° C. for construction and spreading greatly increases construction costs and makes the temperature control difficult during the construction. Doping waste rubber particles as a fine aggregate into the traditional chip seal is a novel development direction that has not been reported in the prior art. However, since the main component of waste tire rubber particles is polyisoprene, which contains a large number of unsaturated double bonds, such that the molecules on the surface of the rubber particles have almost no polarity. As a result, waste rubber particles are inert and difficult to combine with other substances, resulting in poor adhesion between the waste rubber particles and the asphalt. There are many existing methods for pre-treating waste rubber particles. For example, HE Liang et al. use treated rubber particles for cement concrete, where the treated rubber particles had a particle size of 40 mesh. The result shows that polar hydrophilic groups such as carbonyl, imidogen and amide groups are introduced successfully on the rubber surface by oxidation-urea modification, which changes the infiltration type of the rubber surface from hydrophobic to hydrophilic, increase the roughness level of the rubber surface, and increase the bonding strength between rubber and cement matrix by 33.4%.

In the present disclosure, pre-treated waste rubber particles are used to replace the small-sized gravel in the traditional chip seal, thereby obtaining a novel chip seal structure and a construction method thereof, which can improve the recycling efficiency of the waste rubber, maximize the shock absorption performance of the rubber, and conserve resources.

SUMMARY

An object of the present disclosure is to provide a rubber particle-doped composite chip seal and a construction method thereof. On the one hand, the adhesion between the waste rubber particles and the asphalt is improved and the utilization rate of the waste rubber particles in the chip seal is fully utilized by pre-treating the waste rubber particles. On the other hand, pre-treated rubber particles are used as a fine aggregate to replace small-sized gravel in traditional composite-gradation chip seals while overcoming the shortcomings of a single-graded chip seal. This reduces the overall shedding rate of the chip seal, thus improving the surface smoothness and stability of the chip seal.

To achieve the above object, the present disclosure adopts the following technical solutions:

In a first aspect, the present disclosure provides a rubber particle-doped composite chip seal, including a coarse aggregate in a lower layer, a fine aggregate in an upper layer, and a styrene-butadiene-styrene (SBS)-modified emulsified asphalt binding and encapsulating the coarse aggregate and the fine aggregate into a whole, wherein the coarse aggregate is a gravel having a particle size of 4.75 mm to 7.1 mm, the fine aggregate is rubber particles having a particle size of 1.18 mm to 4.75 mm after pre-treatment, and the fine aggregate has a doping amount of 30% to 45% of a volume of all aggregates (the coarse aggregate and the fine aggregate).

In some embodiments, the pre-treatment is conducted by one or more mode selected from the group consisting of alkali washing and ammoniation, and a product obtained after the pre-treatment is washed and dried.

In some embodiments, under the condition that the pre-treatment is conducted by alkali washing, an alkali solution is one or more selected from the group consisting of a mixed solution of NaClO and deionized water and a mixed solution of NaOH and deionized water, and has a mass concentration of 1% to 4%, and the alkali washing is conducted at a temperature of 20° C. to 25° C. for 2 h to 3 h.

In some embodiments, under the condition that the pre-treatment is conducted by ammoniation, an ammonia-containing solution is a mixed solution of urea and deionized water, and has a mass concentration of 1% to 4%, and the ammoniation is conducted at a temperature of 60° C. to 65° C. for 1 h to 3 h, wherein the rubber particles reacts with the ammonia-containing solution for 2 h to 3 h.

In some embodiments, the gravel is an alkaline gravel, and the alkaline gravel is selected from the group consisting of limestone, diabase, and basalt. In some embodiments, the alkaline gravel is limestone.

In some embodiments, the rubber particles have a particle size of 1.18 mm to 2.36 mm. The selection of the rubber particles in this particle size can further reduce the shedding rate of the rubber particles in the chip seal.

In some embodiments, the doping amount of the fine aggregate is in a range of 35% to 40% of the volume of all aggregates (the rubber particles and the gravel). The selection of the doping amount range can further reduce the long-term shedding rate of the rubber particles in the chip seal and improve the sound absorption and shock-absorbing capabilities of the pavement.

In some embodiments, an amount of the gravel is determined by a design method of a Shaanxi (China) chip seal. That is, the gravel is spread all over a rut plate test mold, and a spreading amount of the gravel per unit area is converted by calculating a gravel mass and a rut plate test mold area. The amount of the gravel is calculated according to formula (1):

$$m_s = AAR \times S_s \times r_i \tag{1}$$

wherein $m_S$ represents the amount of the gravel (g); AAR represents a spreading amount of the gravel per unit area (kg/m$^2$); $r_i$ represents a spreading proportion of an i-th type of the gravel (%); and $S_S$ represents a spreading area (m$^2$).

In some embodiment, an amount of the SBS-modified emulsified asphalt is calculated according to formula (2):

$$m_A = (EAR_1 \times r_1 + EAR_2 \times r_2) \times S_A \tag{2}$$

$m_A$ represents the amount of the SBS-modified emulsified asphalt (g); $EAR_1$ and $EAR_2$ represent spreading amounts of asphalts corresponding to aggregates having two different particle sizes, respectively (L/m$^2$); $r_1$ and $r_2$ represent spreading proportions of aggregates having two different particle sizes, respectively (%); and $S_A$ represents a spreading area (m$^2$); and the spreading amount of asphalt is determined according to formulas (3) and (4) based on a McLeod Design calculation method:

$$EAR = \frac{\frac{0.2}{0.5} V \times H \times T + S + A}{R} \tag{3}$$

$$H = \frac{M}{1.139285 + 0.011506FI} \tag{4}$$

wherein EAR represents the spreading amount of asphalt (L/m$^2$); V represents a void ratio of loose gravel (%); H represents an average minimum size of gravel (mm); T represents a traffic volume correction factor; S represents a road condition correction factor; A represents an amount of asphalt absorbed by the gravel (g); R represents a solid content of the emulsified asphalt (g); M represents a median size of the gravel (mm); FI represents a needle flake index; G represents a relative bulk density of a gross volume; W represents a unit mass of the loose gravel (kg/m$^3$); and E represents an aggregate loss coefficient.

In some embodiments, according to a doping amount of the rubber particles, the gravel having the same particle size is replaced by the rubber particles (namely the fine aggregate) by equal volume method. An amount of the replaced gravel is calculated according to formula (1), and an amount of the rubber particles is calculated according to formula (5):

$$m_R = \frac{m_S}{\rho_S} \times \rho_R \tag{5}$$

wherein $m_R$ represents the amount of the rubber particles (g); $m_S$ represents a mass of the gravel having the same particle size replaced by the rubber particles by equal volume method according to the amount of the rubber particles (g); $\rho_S$ represents an apparent density of the gravel (g/cm$^3$); and $\rho_R$ represents an apparent density of the rubber particles (g/cm$^3$).

In a second aspect, the present disclosure provides a method for construction of the rubber particle-doped composite chip seal, including:

spreading the SBS-modified emulsified asphalt evenly on an existing pavement, then spreading the coarse aggregate (the gravel), and then spreading the fine aggregate (pre-treated rubber particles); and spreading a layer of asphalt anti-stripping agent on the fine aggregate after the SBS-modified emulsified asphalt is solidified to obtain a specimen, and then subjecting the specimen to rolling compaction to smooth to obtain a complete chip seal.

In some embodiments, the rubber particle-doped composite chip seal is constructed at room temperature.

In some embodiment, the rubber particle-doped composite chip seal after the construction has a thickness of 6 mm to 12 mm, and preferably 8 mm to 10 mm.

Compared with the prior art, the present disclosure has the following beneficial effects:

1) In the present disclosure, a rubber particle-doped chip seal is provided. The pre-treated rubber particles having a smaller particle size are used to replace the gravels having a smaller particle size in the gravel. The SBS-modified emulsified asphalt is used to combine the gravels having a larger particle size with the rubber particles having a smaller particle size. An optimal spreading proportion and an optimal volume ratio of the gravel to the rubber particles are adopted, such that the elasticity of the rubber particles and the load-bearing performance of the gravel are organically combined to form a chip seal structure with desirable adhesion and excellent particle size composition, and is not easy to fall off. This structure improves the sound absorption capacity and durability of a chip seal-based pavement and reduces the noise generated by tire pumping. Since the rubber particles show a high elasticity and can play a desirable buffering role in the chip seal, they reduce the impact and vibration of car tires on the chip seal-based pavement and improve driving comfort. The rubber particles doped into the chip seal improve the recycling rate of the waste rubber particles, while reducing the amount of gravels with smaller particle size in the chip seal to save resources and costs, and is especially suitable for low-grade pavements.

2) In the present disclosure, it is considered that the molecules on the surface of the rubber particles have almost no polarity and thus appear inert. If the waste rubber particles are directly added to the chip seal, there may be poor stability and strength. Therefore, alkali washing and ammoniation are used to pre-treat the waste rubber particles to improve the bonding performance between the rubber particles and the emulsified asphalt in the chip seal structure, thereby accelerating the demulsification of the modified emulsified asphalt and reducing the shedding rate of the rubber particles in the chip seal.

3) In the present disclosure, the pre-treatment method, particle size, and doping amount of the rubber particles are compared and selected through a large number of indoor experiments. Finally, the obtained NaClO+urea pre-treatment mode is the best pre-treatment method in examples of the present disclosure. The rubber particles have an optimal particle size of 1.18 mm to 2.36 mm and an optimal doping amount of 35% to 40% by volume. The obtained chip seal has the best comprehensive performance, the lowest shedding rate, and a relatively strong sound absorption capacity of the pavement.

4) In the present disclosure, a method for construction of the rubber particle-doped composite chip seal. Specifically, the SBS-modified emulsified asphalt is evenly spread on a pavement, then the gravel is evenly spread on the pavement, and then the pre-treated rubber particles are evenly spread on the pavement. If a single-grade chip seal is used, the rubber particles may easily fall off, and it is impossible to ensure that the size of each aggregate is similar. There are individual aggregates with protruding edges and corners that are prone to falling off due to external effects. Accordingly, by determining the optimal spreading proportion and the optimal particle size of the aggregates and rubber particles, the aggregates and rubber particles can be interlocked closer together to improve the service life of the rubber particle-doped composite chip seal. The asphalt anti-stripping agent can further strengthen the adhesion between the SBS-modified emulsified asphalt and the rubber particles and gravel. The above construction of the chip seal is conducted at room temperature and does not require heating, pre-mixing and other steps, thereby greatly reducing the number of construction steps and improving the efficiency of the construction. At the same time, the above construction can also avoid the segregation of the coarse and fine aggregates (gravel) during the spreading.

BRIEF DESCRIPTION OF THE DRAWINGS

FIGURE shows a structural diagram of the chip seal according to an embodiment of the present disclosure.

In FIGURE, 1 represents rubber particles; 2 represents a gravel; and 3 represents an SBS-modified emulsified asphalt.

DETAILED DESCRIPTION OF THE EMBODIMENTS

The technical solutions in the embodiments of the present disclosure will be clearly and completely described below with reference to the drawings in the examples of the present disclosure. Apparently, the described examples are merely a part, not all of the examples of the present disclosure. Based on the examples of the present disclosure, all other examples obtained by a person of ordinary skill in the art without creative efforts should fall within the scope of the present disclosure.

Example 1

This example provided a preferred method for pre-treating waste rubber particles for a chip seal, which was specifically performed as follows:

1) A waste rubber tire was subjected to crushing, roller compaction, and grinding, obtaining untreated rubber particles having a particle size of 1.18 mm to 2.36 mm. The untreated rubber particles were placed in an alkali solution and subjected to alkali washing at 25° C. for 2 h, wherein the alkali solution was a mixed solution of NaClO and deionized water, with a concentration of 2%. After the alkali washing was finished, the resulting rubber particles were washed with distilled water until they were clear, then placed in an oven and dried until a mass of the washed rubber particles did not change, obtaining treated rubber particles. The treated rubber particles were taken out for later use.

2) The treated rubber particles were placed in an ammonia-containing solution and subjected to ammoniation at 60° C. for 2 h, wherein the ammonia-containing solution was a mixed solution of urea and deionized water, with a concentration of 2%. After the ammoniation was finished, the resulting rubber particles were washed with distilled water until they were clear, then placed in the oven until a mass of the washed rubber particles did not change, obtaining pre-treated rubber particles. The pre-treated rubber particles were taken out for later use.

The pre-treated rubber particles were subjected to a brush test using a wet wheel abrasion meter. The brush test was performed as follows: 54 g of an SBS-modified emulsified asphalt was spread on an asphalt felt having a diameter of 280 mm, and then 120 g of the pre-treated rubber particles were weighted and spread on the SBS-modified emulsified asphalt, waiting for solidifying to be completed.

Comparative Example 1

This comparative example was different from Example 1 in that the rubber particles were untreated, and the remaining steps were the same as those in Example 1.

Comparative Example 2.1

This comparative example was different from Example 1 in that the rubber particles were subjected to alkali washing only with the alkali solution in Example 1, and the remaining steps were the same as those in Example 1.

Comparative Example 2.2

This comparative example was different from Example 1 in that the rubber particles were treated only with urea, and the remaining steps were the same as those in Example 1.

Comparative Example 2.3

This comparative example was different from Example 1 in that the rubber particles were subjected to the alkali washing with a mixed solution of NaOH and deionized water, with a concentration of 3%, and the remaining steps were the same as those in Example 1.

The results of the brush test of Example 1 and Comparative Examples 1 to 2 are summarized in Table 1. As shown in Table 1: compared with Example 1, the shedding rate of the rubber particles in Comparative Example 1 to 2 is higher than that in Example 1. The shedding rate in Comparative Example 1 reaches 50.31%, which is approximately 7.04 times that of Example 1. The shedding rate in Comparative Example 2.1 reaches 17.97%, which is approximately 2.51 times that of Example 1, The shedding rate in Comparative Example 2.2 reaches 21.69%, which is approximately 3.03 times that of Example 1. The shedding rate in Comparative Example 2.3 reaches 47.47%, which is approximately 6.64 times that of Example 1.

TABLE 1

| Modification of rubber particles | | |
|---|---|---|
| Serial Number | Pre-treating Mode | Brush shedding rate (%) |
| Example 1 | NaClO + urea | 7.15 |
| Comparative Example 1 | No treatment | 50.31 |
| Comparative Example 2.1 | NaClO | 17.97 |
| Comparative Example 2.2 | Urea | 21.69 |
| Comparative Example 2.3 | NaOH | 47.47 |

Although both NaClO and NaOH have strong oxidizing properties, NaClO solution can oxidize the C═C double bonds in rubber particles to break the bonds, and the oxidation generates carbonyl groups. The polar groups, amino and carbonyl, are grafted on the surface of rubber particles by treatment with urea solution, thereby increasing the wettability of rubber particles and emulsified asphalt. At the same time, these groups react with groups in the asphalt at the interface area to increase the interface bonding strength. The adhesion between the rubber particles and the emulsified asphalt can be further increased by treating the rubber particles with NaClO solution and urea. The pre-treatment effect of NaClO or urea alone is lower than that of NaClO and urea.

Example 2

This example provided a rubber particle-doped composite chip seal, consisting of a coarse aggregate in a lower layer, a fine aggregate in an upper layer, and an SBS-modified emulsified asphalt binding and encapsulating the coarse aggregate and the fine aggregate into a whole, wherein the coarse aggregate was a gravel having a particle size of 4.75 mm to 7.1 mm; and the fine aggregate was the rubber particles having a particle size of 1.18 mm to 2.36 mm pre-treated according to Example 1.

A production process of a traditional composite-gradation chip seal specimen was performed as follows:

At room temperature, a corresponding mass of SBS-modified emulsified asphalt was accurately weighed and spread on an asphalt felt with a spreading diameter of 280 mm. A limestone was subjected to a first spreading, that is, the limestone was spread on an upper layer of the SBS-modified emulsified asphalt, wherein a volume of the limestone accounted for 50% to 70%, and the limestone had a particle size of 4.75 mm to 7.1 mm. Then the limestone was subjected to a second spreading, wherein a volume of the limestone accounted for 30% to 50%, and the limestone had a particle size of 1.18 mm to 2.36 mm, obtaining a specimen. After the specimen was subjected to full rolling compaction, a chip seal specimen was completely solidified for later use.

In order to test the performance of the rubber particle-doped composite chip seal, a rubber particle-doped composite chip seal specimen was produced in this example. The differences between the production processes of the rubber particle-doped composite chip seal specimen and the traditional composite-gradation chip seal were as follows: under the condition that the amount of the limestone in the first spreading kept unchanged, the limestone in the second spreading was replaced with the same volume of the rubber particles obtained after pre-treatment as in Example 1. The pre-treated rubber particles were spread on an upper layer of a gravel in the first spreading, wherein a volume of the pre-treated rubber particles accounted for 30% to 50%, and a particle size of the pre-treated rubber particles was 1.18 mm to 2.36 mm, obtaining a specimen. After the specimen was subjected to full rolling compaction, a chip seal specimen was completely solidified for later use.

It should be noted that the amount of the gravel was determined by a design method of a Shaanxi chip seal. That is, the gravel was spread all over a rut plate test mold, and a spreading amount of the gravel per unit area was converted by calculating a gravel mass and a rut plate test mold area. The spreading amount of the gravel per unit area was shown in Table 2, and the internal dimension of the rut plate test mold was 30 cm×30 cm. The amount of the gravel was calculated according to formula (1):

$$m_s = AAR \times S_s \times r_i \tag{1}$$

wherein $m_S$ represents the amount of the gravel (g); AAR represents a spreading amount of the gravel per unit area (kg/m$^2$); $r_1$ represents a spreading proportion of an i-th type of the gravel (%); and $S_S$ represents a spreading area (m$^2$), wherein the asphalt felt had an area of 0.0616 m$^2$.

TABLE 2

| Spreading amount of the gravel per unit area | | | |
|---|---|---|---|
| Particle size of gravel | 7.1-9.5 mm | 4.75-7.1 mm | 2.36-4.75 mm |
| Mass of gravel used (g) | 894 | 693 | 423 |
| spreading amount AAR (kg/m$^2$) | 9.93 | 7.70 | 4.70 |

It should be noted that for composite-gradation chip seal, the amount of the asphalt was calculated according to formula (2):

$$m_A = (EAR_1 \times r_1 + EAR_2 \times r_2) \times S_A \tag{2}$$

wherein $m_A$ represents an amount of the SBS-modified emulsified asphalt (g); $EAR_1$ and $EAR_2$ represent spreading amounts of asphalts corresponding to the coarse aggregate and the fine aggregate, respectively (L/m$_2$); $r_1$ and $r_2$ represent spreading proportions of the coarse aggregate and the fine aggregate, respectively (%); and $S_A$ represents a spreading area (m$^2$); wherein the asphalt felt had an area of 0.0616 m$^2$.

The spreading amount of the asphalt was determined according to formulas (3) and (4) based on a McLeod Design calculation method:

$$EAR = \frac{\frac{0.2}{0.5} V \times H \times T + S + A}{R} \tag{3}$$

$$H = \frac{M}{1.139285 + 0.011506FI} \tag{4}$$

wherein EAR represents the spreading amount of the asphalt (L/m$^2$); V represents a void ratio of a loose gravel (%); H represents an average minimum size of the gravel (mm); T represents a traffic volume correction factor; S represents a road condition correction factor; A represents an amount of the asphalt absorbed by the gravel (g); R represents a solid content of the emulsified asphalt (g); M represents a median size of the gravel (mm); FI represents a needle flake index; G represents a relative bulk density of a gross volume; W represents a unit mass of the loose gravel (kg/m$^3$); and E represents an aggregate loss coefficient.

Since this example is an indoor experiment, partial values in formulas (2) to (4) are as follows: E=1, S=0; a residual content of the emulsified asphalt is about 55.5%, taking R=0.555, considering low-grade traffic highways and taking T=0.75; it was generally believed that the absorption rate of the asphalt by the gravel is 1%, and the amount of the asphalt increases by about 0.09 L/m$^2$, such that A=0.09 is at this time.

The calculation results of the spreading amount of the asphalt are shown in Table 3. In this example, only the pre-treated rubber particles are used to replace the fine aggregate (small particle-size gravel) in the traditional composite-gradation chip seal, and the amount of the asphalt does not change with the rubber particles. Therefore, by substituting the data in Table 2 into formula (2), the total amount of the SBS-modified emulsified asphalt in the rubber particle-doped composite chip seal specimen can be obtained.

TABLE 3

Calculation table for the spreading amount of the asphalt

| Calculation parameters | Particle size range of gravel | | |
|---|---|---|---|
| | 7.1-9.5 mm | 4.75-7.1 mm | 2.36-4.75 mm |
| M (mm) | 8.3 | 5.9 | 3.5 |
| FI (%) | 12.0 | 10.7 | 8.2 |
| H (mm) | 6.50 | 4.67 | 2.77 |
| W | 1386 | 1375 | 1369 |
| G | 2.665 | 2.661 | 2.658 |
| V (%) | 48.0 | 48.3 | 48.5 |
| E | 1 | 1 | 1 |
| T | 0.75 | 0.75 | 0.75 |
| S | 0 | 0 | 0 |
| A | 0.09 | 0.09 | 0.09 |
| R | 0.555 | 0.555 | 0.555 |
| EAR (L/m$^2$) | 1.85 | 1.38 | 0.91 |

In should be noted that according to the doping amount of the rubber particle in this example, the gravel having the same particle size is replaced by the rubber particles (namely the fine aggregate) by an equal volume method. An amount of the repalced gravel is calculated according to formula (1), and the amount of the rubber particle is calculated according to formula (5):

$$m_R = \frac{m_S}{\rho_S} \times \rho_R \tag{5}$$

wherein $m_R$ represents the amount of the rubber particle (g); $m_S$ represents a mass of the gravel having the same particle size replaced by the rubber particles by equal volume method according to the amount of the rubber particle (g); $\rho_S$ represents an apparent density of the gravel (g/cm$^3$); and $\rho_R$ represents an apparent density of the rubber particles (g/cm$^3$).

Comparative Example 3

This comparative example was different from Example 2 in that the spread rubber particles had a particle size of 2.36 mm to 4.75 mm, and the remaining steps were the same as those in Example 2.

The chip seal specimens in Example 2 and Comparative Example 3 were subjected to a noise test using the indoor tire accelerated sliding test, and measured with a decibel meter. The test results are shown in Table 4. Table 4 also includes the amounts of the rubber particles and the sphalt calculated in Example 2 and Comparative Example 3.

TABLE 4

Noise value of tire rolling and falling

| Rubber particle doping amount | Rubber particle amount/g | Asphalt amount/g | Decibel value/dB | |
|---|---|---|---|---|
| | | | Example 2 | Comparative Example 3 |
| 30% | 36.7 | 76.3 | 65.5 | 65.6 |
| 35% | 42.8 | 74.9 | 64.6 | 64.8 |
| 40% | 48.9 | 73.4 | 63.9 | 64.1 |
| 45% | 55.0 | 71.9 | 63.3 | 63.6 |
| 50% | 61.1 | 70.5 | 63.0 | 63.4 |

As shown in Table 4:

1) As the doping amount of the rubber particles increases from 30% to 50%, the decibel values generated by the chip seal specimens in Comparative Example 3 and Example 2 gradually decrease. Example 2 is reduced from 65.5 dB to 63.0 dB, and Comparative Example 3 is reduced from 65.6 dB to 63.4 dB. This indicates that increasing the doping amount of the rubber particles can improve the sound absorption capacity of chip seal pavement and reduce the noise generated by tire pumping.

2) When the rubber particle size increases from 1.18 mm to 2.36 mm to 2.36 mm to 4.75 mm, the overall decibel value of Example 3 is higher than that of Comparative Example 2. That is to say, the increase in the particle size of the rubber particles has a certain impact on the sound absorption capacity of chip seal pavement. Moreover, the greater the doping amount of the rubber particles, the more obvious this effect is.

A tire vertical vibration attenuation test was conducted to conduct the vibration attenuation test on Example 2 and Comparative Example 3. The tires used were van tires (tire pressure 0.25 MPa, 165/70R13). The test results are shown in Table 5. As shown in Table 5, as the doping amount of the rubber particles increases, the vibration attenuation coefficient gradually increases, but the growth rate slows down after 45%. This indicates that when the doping amount of the rubber particles is in a range of 30% to 45%, the rubber particle-doped composite chip seal has a desirable shock absorption effect. Comparing Example 2 and Comparative Example 3, the particle size of the rubber particles increases and the shock absorption effect is improved.

TABLE 5

Test results of tire free vibration attenuation of chip seal

| Rubber particle doping amount | Vibration attenuation coefficient ε | |
|---|---|---|
| | Example 2 | Comparative Example 3 |
| 0% | 5.554 | 5.554 |
| 30% | 5.954 | 6.047 |
| 35% | 6.137 | 6.250 |
| 40% | 6.456 | 6.756 |
| 45% | 6.614 | 6.935 |
| 50% | 6.708 | 7.027 |

Comparative Example 4

This comparative example was different from Example 2 in that the gravel in the first spreading had a particle size of 7.1 mm to 9.5 mm, and the rubber particles in the second spreading had a particle size of 2.36 mm to 4.75 mm, and the remaining steps were the same as in Example 2.

Comparative Example 5

This comparative example was different from Example 2 in that the gravel in the first spreading had a particle size of 7.1 mm to 9.5 mm, and the rubber particles in the second spreading had a particle size of 4.75 mm to 7.1 mm, and the remaining steps were the same as in Example 2.

The products obtained in Example 2, Comparative Example 3, Comparative Example 4, and Comparative Example 5 were subjected to a 5-min brush test using a wet wheel abrasion meter, wherein the rubber particles used in the brush test included untreated rubber particles and pre-treated rubber particles. The test results are shown in Table 6.

TABLE 6

Results of brush test

| Experimental group | Particle size of the gravel | Particle size of the rubber particles | Proportion of the rubber particles | Shedding rate (%) Untreated rubber particles | Shedding rate (%) Pre-treated rubber particles |
|---|---|---|---|---|---|
| Comparative Example 5 | 7.1-9.5 mm | 4.75-7.1 mm | 30% | 19.09 | 11.68 |
| | | | 35% | 22.17 | 13.26 |
| | | | 40% | 28.93 | 15.07 |
| | | | 45% | 40.51 | 19.75 |
| | | | 50% | 48.59 | 24.19 |
| Comparative Example 4 | 7.1-9.5 mm | 2.36-4.75 mm | 30% | 14.32 | 7.59 |
| | | | 35% | 17.74 | 8.93 |
| | | | 40% | 23.62 | 11.73 |
| | | | 45% | 27.26 | 14.54 |
| | | | 50% | 34.89 | 17.29 |
| Comparative Example 3 | 4.75-7.1 mm | 2.36-4.75 mm | 30% | 9.61 | 5.63 |
| | | | 35% | 12.37 | 7.02 |
| | | | 40% | 15.79 | 8.48 |
| | | | 45% | 20.58 | 9.42 |
| | | | 50% | 24.79 | 13.09 |
| Example 2 | 4.75-7.1 mm | 1.18-2.36 mm | 30% | 7.05 | 3.85 |
| | | | 35% | 8.86 | 4.71 |
| | | | 40% | 11.62 | 5.36 |
| | | | 45% | 13.05 | 6.97 |
| | | | 50% | 15.46 | 8.14 |

As shown in Table 6:

1) For the untreated rubber particle-doped chip seal, when the particle size of the gravel is determined, with the same proportion of the rubber particles, the brush shedding rate increases as the particle size of the rubber particles increases. The average shedding rates of the rubber particles at different proportions in Comparative Example 5, Comparative Example 4, Comparative Example 3, and Example 2 are 31.9%, 23.6%, 16.6%, and 11.2%, respectively. This indicates that reducing in the particle size of the rubber particles can effectively reduce the brush shedding rate of the chip seal, and the shedding rate of Example 2 is much lower than that of Comparative Examples 3, 4, and 5.

2) In the pre-treated rubber particle-doped chip seal, the overall shedding rate of the chip seal can also be reduced, with the same law as that of the untreated rubber particle-doped chip seal. Moreover, the average shedding rates of the rubber particles at different proportions in Comparative Example 5, Comparative Example 4, Comparative Example 3, and Example 2 are 16.8%, 12.0%, 8.7%, and 5.8%, which are reduced by 47.3%, 49.1%, 47.6%, and 48.2%, respectively, compared with the untreated rubber particle-doped chip seal. Obviously, the use of the pre-treated rubber particles in the chip seal can significantly reduce the brush shedding rate of the rubber particles.

3) For the gravel and rubber particles having specific particle sizes, the proportion of rubber particles increases and the shedding rate of the chip seal increases.

Comparative Example 6

This comparative example was different from Example 2 in that the gravel in the first spreading had a particle size of 7.1 mm to 9.5 mm, and the gravel in the second spreading had a particle size of 4.75 mm to 7.1 mm, and the remaining steps were the same as in Example 2.

Comparative Example 7

This comparative example was different from Example 2 in that the gravel in the first spreading had a particle size of 7.1 mm to 9.5 mm, and the gravel in the second spreading had a particle size of 2.36 mm to 4.75 mm, and the remaining steps were the same as in Example 2.

Comparative Example 8

This comparative example was different from Example 2 in that the gravel in the first spreading had a particle size of 4.75 mm to 7.1 mm, and the gravel in the second spreading had a particle size of 2.36 mm to 4.75 mm, and the remaining steps were the same as in Example 2.

Comparative Example 9

This comparative example was different from Example 2 in that the gravel in the first spreading had a particle size of 4.75 mm to 7.1 mm, and the gravel in the second spreading had a particle size of 1.18 mm to 2.36 mm, and the remaining steps were the same as in Example 2.

The chip seal specimens in Example 2, Comparative Example 3, Comparative Example 4, Comparative Example 5, Comparative Example 6, Comparative Example 7, Comparative Example 8, and Comparative Example 9 were subjected to a brush noise test using a wet wheel abrasion test and a decibel meter. The anti-skid performance of the chip seal specimens was evaluated with reference to a manual sand laying method and the pendulum friction meter method in the "Field Test Methods of Highway Subgrade and Pavement" (JTG 3450-2019). The particle size comparison and test results of the gravel and rubber particles in Example 2 and Comparative Examples 3 to 9 are shown in Table 7 and Table 8.

TABLE 7

Brush noise and anti-skid performance of the rubber particle-doped composite chip seal

| Experimental group | Particle size of the gravel/mm | Particle size of the rubber particles/mm | Proportion of the rubber particles | $L_{10}$ | $L_{50}$ | $L_{90}$ | $L_{eq}$ | Structural depth |
|---|---|---|---|---|---|---|---|---|
| Example 2 | 4.75-7.1 | 1.18-2.36 | 30% | 77.9 | 76.2 | 75.3 | 76.3 | 2.18 |
| | | | 35% | 77.5 | 75.9 | 75.0 | 76.0 | 2.05 |
| | | | 40% | 75.4 | 75.5 | 73.4 | 75.6 | 1.97 |
| | | | 45% | 75.6 | 74.9 | 73.0 | 75.0 | 1.83 |
| | | | 50% | 75.4 | 74.7 | 72.6 | 74.8 | 1.64 |
| Comparative Example 3 | 4.75-7.1 | 2.36-4.75 | 30% | 77.5 | 76.4 | 74.8 | 76.5 | 2.57 |
| | | | 35% | 77.1 | 76.2 | 74.2 | 76.3 | 2.50 |
| | | | 40% | 76.5 | 75.7 | 73.9 | 75.8 | 2.34 |
| | | | 45% | 75.8 | 75.5 | 73.5 | 75.6 | 2.22 |
| | | | 50% | 75.8 | 75.1 | 73.1 | 75.2 | 2.08 |
| Comparative Example 4 | 7.1-9.5 | 2.36-4.75 | 30% | 79.2 | 77.5 | 76.8 | 77.6 | 3.20 |
| | | | 35% | 78.7 | 77.6 | 76.6 | 77.7 | 3.02 |
| | | | 40% | 78.3 | 77.4 | 75.8 | 77.5 | 3.04 |
| | | | 45% | 78.6 | 77.2 | 76.1 | 77.3 | 2.87 |
| | | | 50% | 78.4 | 76.8 | 75.9 | 76.9 | 2.77 |
| Comparative Example 5 | 7.1-9.5 | 4.75-7.1 | 30% | 79.7 | 78.1 | 77.7 | 78.2 | 3.44 |
| | | | 35% | 79.0 | 77.7 | 76.5 | 77.8 | 3.30 |
| | | | 40% | 78.9 | 77.8 | 76.4 | 77.9 | 3.29 |
| | | | 45% | 78.7 | 77.7 | 76.6 | 77.8 | 3.25 |
| | | | 50% | 78.3 | 77.2 | 76.2 | 77.3 | 3.01 |

Notes $L_{10}$ represents a noise level exceeded 10% of the time during the test, which is equivalent to an average peak value of the noise;

$L_{50}$ represents a noise level exceeded 50% of the time during the test, which is equivalent to an average of the noise;

$L_{90}$ represents a noise level exceeded 90% of the time during the test, which is equivalent to a background value of the noise;

$L_{eq}$ represents a continuous sound level during the test;

Structural depth: evaluating the roughness of the pavement; the smaller the structural depth, the closer the gravel arrangement and the better the anti-skid performance are.

TABLE 8

Brush noise of the chip seal without doping rubber particles

| Experimental group | Particle size of the gravel in the first spreading/mm | Particle size of the gravel in the second spreading/mm | Proportion of small-particle-size aggregates | $L_{10}$ | $L_{50}$ | $L_{90}$ | $L_{eq}$ | Structural depth |
|---|---|---|---|---|---|---|---|---|
| Comparative Example 6 | 7.1-9.5 | 4.75-7.1 | 30% | 80.3 | 78.6 | 77.8 | 78.7 | 3.30 |
| | | | 35% | 79.5 | 78.5 | 77.2 | 78.6 | 3.27 |
| | | | 40% | 79.7 | 78.6 | 77.5 | 78.7 | 3.10 |
| | | | 45% | 79.8 | 78.5 | 76.7 | 78.7 | 3.12 |
| | | | 50% | 79.4 | 78.5 | 77.5 | 78.6 | 2.88 |
| Comparative Example 7 | 7.1-9.5 | 2.36-4.75 | 30% | 80.5 | 78.5 | 77.6 | 78.6 | 3.19 |
| | | | 35% | 79.8 | 78.5 | 77.5 | 78.6 | 2.85 |
| | | | 40% | 79.6 | 78.4 | 77.2 | 78.5 | 2.87 |
| | | | 45% | 80.3 | 78.4 | 78.2 | 78.5 | 2.73 |
| | | | 50% | 79.8 | 78.4 | 77.9 | 78.5 | 2.64 |
| Comparative Example 8 | 4.75~7.1 | 2.36~4.75 | 30% | 79.1 | 77.8 | 76.5 | 77.9 | 2.31 |
| | | | 35% | 78.6 | 77.7 | 76.2 | 77.8 | 2.37 |
| | | | 40% | 78.8 | 77.5 | 76.1 | 77.6 | 2.21 |
| | | | 45% | 78.5 | 77.6 | 76.5 | 77.7 | 2.12 |
| | | | 50% | 78.3 | 77.5 | 75.5 | 77.6 | 1.84 |
| Comparative Example 9 | 4.75~7.1 | 1.18~2.36 | 30% | 78.8 | 77.5 | 76.8 | 77.6 | 2.10 |
| | | | 35% | 78.6 | 77.6 | 76.7 | 77.7 | 1.96 |
| | | | 40% | 78.3 | 77.4 | 76.5 | 77.5 | 1.90 |
| | | | 45% | 78.3 | 77.3 | 76.3 | 77.4 | 1.70 |
| | | | 50% | 78.5 | 77.3 | 76.4 | 77.4 | 1.55 |

Notes $L_{10}$ represents a noise level exceeded 10% of the time during the test, which is equivalent to an average peak value of the noise;

$L_{50}$ represents a noise level exceeded 50% of the time during the test, which is equivalent to an average of the noise;

$L_{90}$ represents a noise level exceeded 90% of the time during the test, which is equivalent to a background value of the noise;

$L_{eq}$ represents a continuous sound level during the test;

Structural depth: evaluating the roughness of the pavement; the smaller the structural depth, the closer the gravel arrangement and the better the anti-skid performance are.

It can be seen from Tables 7 and 8 that:

1) The average noise values of Comparative Example 5, Comparative Example 4, Comparative Example 3, and Example 2 are 77.8 dB, 77.4 dB, 75.9 dB, and 75.5 dB, respectively. The average noise values of Comparative Examples 9, 8, 7, and 6 are 78.6 dB, 78.5 dB, 77.7 dB, and 77.5 dB, which are reduced by 0.8 dB, 1.1 dB, 1.8 dB, and 2.0 dB, respectively, compared with the chip seal without doping rubber particles. In Comparative Examples 5 and 4, the gravels have a particle size of 7.1 mm to 9.5 mm. Compared with Comparative Examples 6 and 7, the reduction in the noise value is not significant, even if partial rubber particles are added, while the noise values in Comparative Example 3 and Example 2 are reduced by 1.8 dB and 2.0 dB, respectively. The result indicates that the particle size of the coarse aggregate (gravel) in the chip seal has a greater influence on the noise value. The selection of the gravel having a particle size of 4.75 mm to 7.1 mm in combination with the rubber particles can effectively reduce the brush noise of the chip seal.

The reason for the reduction in the brush noise of the chip seal is that the rubber particles have a desirable elasticity and play a buffering role in the chip seal. When the brush head contacts the chip seal, the rubber particles deform to store energy. After the brush head leaves the chip seal, the rubber particles resume their deformation. Compared with the direct collision between the gravel and the rubber pipes, this process reduces the impact and vibration, thereby reducing the noise value.

2) For the chip seal without doping rubber particles, the particle size of the gravel in the first spreading is reduced from 7.1 mm to 9.5 mm to 4.75 mm to 7.1 mm, and the structural depth decreases accordingly. For example, the average structural depth in Comparative Example 6 is 3.13 mm, and the average structural depth in Comparative Example 8 is 2.17 mm, which is reduced by 30.7% compared with that of Comparative Example 6. This is mainly due to the large gaps when the gravel having large-diameter is arranged in a single layer. The reduction in the particle size can make the arrangement of the gravel tighter, such that the smoothness and slip resistance of the surface of the chip seal are slightly improved.

Comparing the structural depths of the chip seal with and without doping rubber particles, it can be seen that the structural depth of the chip seal with doping rubber particles has an upward trend. Taking the proportion of the fine aggregate (rubber particles or small-sized gravel) at 30% as an example, the structural depths of Comparative Example 5, Comparative Example 4, Comparative Example 3, and Example 2 are 3.44 mm, 3.20 mm, 2.57 mm, and 2.18 mm, respectively, while the structural depths of Comparative Examples 6, 7, 8, and 9 are 3.30 mm, 3.19 mm, 2.31 mm, and 2.10 mm, respectively, which are slightly lower than those of the former. Analysis of the reasons for this shows that the rubber particles have the characteristics of high elasticity, which is prone to rebound during the compaction process, resulting in some gaps between the rubber particles. Therefore, the structural depth of the rubber particle-doped composite chip seal increases slightly, but has no significant increase, indicating that the rubber particles have little influence on the slip resistance performance of the chip seal.

Combining Tables 4 to 8, it can be seen that the vibration reduction effect of Comparative Example 3 is better than that of Example 2. However, since the rubber particles of Comparative Example 3 have a larger particle size than those of Example 2, the brush shedding rate of Example 2 is much better. Generally speaking, Example 2 has the best overall performance. However, when the practical engineering requires higher shock absorption for the chip seal, the gravel and rubber particles in Comparative Example 3 can also be selected.

Example 3

Specific steps were performed as follows:

At room temperature, 73.4 g of an SBS-modified emulsified asphalt (shown in Table 4) was accurately weighed and spread on an asphalt felt with a spreading diameter of 280 mm. A first spreading was conducted, that is, a gravel was spread on an upper layer of the SBS-modified emulsified asphalt, wherein the gravel was limestone with a mass of 284.5 g, a volume proportion of 60%, and a particle size of 4.75 mm to 7.1 mm. Then a second spreading was conducted, that is, rubber particles pre-treated as the manner in Example 1 were spread on an upper layer of the gravel, wherein the rubber particles had a mass of 48.9 g, a volume proportion of 40%, and a particle size of 1.18 mm to 2.36 mm, obtaining a specimen. The specimen was subjected to full rolling compaction, obtaining a chip seal specimen. After the chip seal specimen was completely solidified, the solidified chip seal specimen was subjected to an accelerated loading test using a wheel loader, and the loading conditions were 0.3 MPa and 120 times/min, respectively.

Comparative Example 10

This comparative example was different from Example 3 in that the volume proportion of the limestone accounted for 70%, the volume proportion of the rubber particles accounted for 30%, and the remaining steps were the same as in Example 3.

Comparative Example 11

This comparative example was different from Example 3 in that the volume proportion of the limestone accounted for 65%, the volume proportion of the rubber particles accounted for 35%, and the remaining steps were the same as in Example 3.

Comparative Example 12

This comparative example was different from Example 3 in that the volume proportion of the limestone accounted for 55%, the volume proportion of the rubber particles accounted for 45%, and the remaining steps were the same as in Example 3.

Comparative Example 13

This comparative example was different from Example 3 in that the volume proportion of the limestone accounted for 50%, the volume proportion of the rubber particles accounted for 50%, and the remaining steps were the same as in Example 3.

Test results of Example 3 and Comparative Examples 10 to 13 are shown in Table 9. It can be seen from Table 9 that:

When the mass proportion of the gravel to the rubber particles is fixed, as the number of loading times increases, the shedding rate of the rubber particles in the chip seal specimens in Example 3 and Comparative Examples 10 to 13 gradually increases. When the loading times are the same and the mass proportion of the rubber particles gradually increases from 30% to 50%, the shedding rate of the rubber particles decreases and then increases. There is a minimum shedding rate when the mass proportion of the rubber particles is 40%. When the number of the loading times is 100,000, the shedding rate of the chip seal specimen in Example 3 is only 30.46%, and that of Comparative Example 11 is 34.25%. it can be seen that when the proportion of the rubber particles is in a range of 35% to 40%, the shedding rate of the chip seal is extremely low and the sound absorption capacity of the pavement is strong. According to the results of Example 3 and Comparative Example 12, it is inferred that when the proportion of the rubber particles is in a range of 40% to 43%, the shedding rate of the chip seal is lower and the sound absorption capacity of the pavement is also stronger.

TABLE 9

| Long-term shedding rate | | | | | | | |
|---|---|---|---|---|---|---|---|
| | Proportion of the | Shedding rate (%) | | | | | |
| Serial Number | rubber particles | 5,000 times | 10,000 times | 20,000 times | 40,000 times | 60,000 times | 100,000 times |
| Comparative Example 10 | 30% | 9.57 | 17.30 | 22.09 | 29.09 | 32.40 | 37.19 |
| Comparative Example 11 | 35% | 5.52 | 11.80 | 16.94 | 24.36 | 28.92 | 34.25 |
| Example 3 | 40% | 4.35 | 10.29 | 16.22 | 22.15 | 25.71 | 30.46 |
| Comparative Example 12 | 45% | 6.61 | 13.42 | 20.64 | 27.46 | 31.38 | 36.13 |
| Comparative Example 13 | 50% | 8.54 | 19.63 | 26.25 | 32.86 | 36.49 | 42.25 |

To sum up, in the pre-treatment tests of Example 1 and Comparative Examples 1 to 2, the rubber particles treated with NaClO solution and urea solution have the best adhesion to the SBS-modified emulsified asphalt and the lowest shedding rate, followed by the pre-treatment mode using NaClO or urea alone. In the brush test of the chip seal specimens in Example 2 and Comparative Examples 3 to 5, the chip seal prepared with SBS-modified emulsified asphalt, 4.75 mm to 7.1 mm of gravel, and 1.18 mm to 2.36 mm of pre-treated rubber particles in Example 2 have the lowest shedding rate, followed by the chip seal prepared with 2.36 mm to 4.75 mm of pre-treated rubber particle in the Comparative examples. In the brush noise test of Example 2 and Comparative Examples 3 to 9, when the doping amount of the rubber particles is greater than 40%, the noise reduction rate of the chip seal-based pavement slows down, and the reduction is more obvious after 45%. In addition, when the doping amount of the rubber particles is too large, the brush shedding rate of the chip seal increases rapidly. Therefore, it is better to control the doping amount of the rubber particles in a range of 30% to 45%, preferably within 35% to 40%. Through the tire accelerated sliding noise test in Example 2 and Comparative Example 3, it can be seen that the larger particle size of gravel makes the noise of the chip seal louder, so the gravel particle size is controlled doping amount 4.75 mm to 7.1 mm. Through the accelerated loading test of Example 3 and Comparative Examples 10 to 13 to simulate the actual shedding of the rubber particle-doped composite chip seal, for the chip seal composed of SBS-modified emulsified asphalt, 4.75 mm to 7.1 mm of the gravel, and 1.18 mm to 2.36 mm of the rubber particles, when the doping amount of the rubber particles is in a range of 30% to 45%, the shedding rate of the chip seal is lower, the pavement has a stronger sound absorption capacity. The above properties are most stable at a doping amount of 35% to 40%, leading to a lower long-term shedding rate.

Example 4

This example provided a method for constructing a rubber particle-doped composite chip seal, which was performed as follows: an SBS-modified emulsified asphalt was spread evenly on an existing pavement, then a gravel was spread, and then pre-treated rubber particles prepared according to Example 1 were spread, obtaining a specimen. Then the specimen was subjected to full rolling compaction to smooth, obtaining a complete chip seal. The rubber particle-doped composite chip seal obtained after construction had a thickness of 6 mm to 12 mm, and preferably 8 mm to 10 mm.

Specifically, when the gravel had a particle size of 4.75 mm to 7.1 mm, the rubber particles had a particle size of 1.18 mm to 2.36 mm, and the rubber particles had a doping amount of 40%, the rubber particle-doped composite chip seal obtained after construction had a thickness of about 10 mm.

This example had the following beneficial effects:

Suitable spreading proportion and particle size ranges of the gravel and the rubber particles are adopted to make the interlocking between the aggregates and rubber particles tighter, thereby improving the service life of the rubber particle-doped composite chip seal, and providing the road sound absorption performance, shock absorption performance and driving comfort. The above construction of the chip seal is conducted at room temperature, without heating, pre-mixing and other steps, which greatly reduces the number of construction steps and greatly improves the efficiency of the construction, while also avoiding the problem of the segregation of the coarse and fine aggregates (the gravel) during the spreading. When the pre-treated rubber particles have a particle size of 1.18 mm to 2.36 mm and a doping amount of 35% to 40%, the overall performance of the chip seal is the best.

Contents not detailed in the present disclosure may be the prior art.

The above descriptions are only the preferred embodiments of the present disclosure, but not to limit the scope of the present disclosure. Any modifications, equivalent substitutions, and improvements made within the spirit and scope of the present disclosure should fall within the scope of the present disclosure.

What is claimed is:

1. A rubber particle-doped composite chip seal, comprising:

a coarse aggregate in a lower layer;

a fine aggregate in an upper layer; and a styrene-butadiene-styrene (SBS)-modified emulsified asphalt binding and encapsulating the coarse aggregate and the fine aggregate into a whole, wherein the coarse aggregate is a gravel having a particle size of 4.75 mm to 7.1 mm, the fine aggregate is rubber particles having a particle size of 1.18 mm to 4.75 mm, and the fine aggregate has a doping amount of 30% to 45% of a volume of all aggregates.

2. The rubber particle-doped composite chip seal of claim 1, wherein the gravel is an alkaline gravel.

3. A method for construction of a rubber particle-doped composite chip seal, the method comprising:

spreading an SBS-modified emulsified asphalt evenly on an existing pavement, then spreading a coarse aggregate, and then spreading a fine aggregate; and spreading a layer of an asphalt anti-stripping agent on the fine aggregate after the SBS-modified emulsified asphalt is solidified to obtain a specimen, and then subjecting the specimen to rolling compaction to smooth to obtain a complete chip seal, wherein the fine aggregate is rubber particles having a particle size of 1.18 mm to 4.75 mm.

4. The method for construction of the rubber particle-doped composite chip seal of claim 3, wherein the chip seal has a thickness of 6 mm to 12 mm.

5. The method for construction of the rubber particle-doped composite chip seal of claim 3, wherein the coarse aggregate is an alkaline gravel.

* * * * *